US005844518A

United States Patent [19]

Berg et al.

[11] Patent Number: 5,844,518

[45] Date of Patent: Dec. 1, 1998

[54] THERMOPLASTIC SYNTACTIC FOAM WAFFLE ABSORBER

[75] Inventors: Donald J. Berg, Mesa, Ariz.; Carl A. Mentzer, Poway, Calif.; David A. Brooker, Tempe, Ariz.; Gregory J. Sapletal, Ramona, Calif.

[73] Assignee: McDonnell Douglas Helicopter Corp., Mesa, Ariz.

[21] Appl. No.: 799,916

[22] Filed: Feb. 13, 1997

[51] Int. Cl.[6] ..... H01Q 17/00

[52] U.S. Cl. ..... 342/2; 342/4

[58] Field of Search ..... 342/1, 2, 3, 4

[56] References Cited

U.S. PATENT DOCUMENTS

| | | | |
|---|---|---|---|
| 2,870,439 | 1/1959 | Stinehelfer | 342/4 |
| 2,977,591 | 3/1961 | Tanner | 342/1 |
| 3,295,133 | 12/1966 | Emerson et al. | 342/4 |
| 3,315,259 | 4/1967 | Wesch | 342/3 |
| 3,348,224 | 10/1967 | McMillan | 342/1 |
| 3,441,933 | 4/1969 | Tuinila et al. | 342/4 |
| 3,631,492 | 12/1971 | Suetake et al. | 342/4 |
| 3,836,967 | 9/1974 | Wright | 342/4 |
| 4,023,174 | 5/1977 | Wright | 342/4 |
| 4,050,073 | 9/1977 | Wesch | 342/4 |
| 4,164,718 | 8/1979 | Iwasaki | 342/4 X |
| 4,381,510 | 4/1983 | Wren | 342/1 X |
| 4,496,950 | 1/1985 | Hemming et al. | 342/4 |
| 4,595,623 | 6/1986 | Du Pont et al. | 428/195 |
| 4,809,003 | 2/1989 | Dominek et al. | 342/165 |
| 4,865,784 | 9/1989 | Hill | 264/45.3 |
| 4,931,798 | 6/1990 | Kogo | 342/4 |
| 4,942,402 | 7/1990 | Prewer et al. | 342/1 |
| 4,973,963 | 11/1990 | Kurosawa et al. | 342/4 |
| 5,032,627 | 7/1991 | Wilson et al. | 523/218 |
| 5,120,769 | 6/1992 | Dyksterhouse et al. | 521/54 |
| 5,125,992 | 6/1992 | Hubbard et al. | 342/1 X |
| 5,208,599 | 5/1993 | Rudduck et al. | 342/4 |
| 5,356,958 | 10/1994 | Matthews | 523/219 |
| 5,384,571 | 1/1995 | Myers et al. | 342/4 |
| 5,453,745 | 9/1995 | Kudo et al. | 342/1 |
| 5,532,295 | 7/1996 | Harrison et al. | 523/218 |
| 5,617,095 | 4/1997 | Kim et al. | 342/1 |
| 5,642,118 | 6/1997 | Grannemann | 342/4 |

*Primary Examiner*—John B. Sotomayor
*Attorney, Agent, or Firm*—Donald E. Stout; Kenton R. Mullins

[57] ABSTRACT

The microwave absorption performance of a fiber loaded thermoplastic syntactic material is improved by geometrically reshaping the surface into a waffle shape. Starting with a fiber loaded version of thermoplastic syntactic foam, the front face geometry is then modified. Typically, the angle and frequency response is a function of both the front face angle and the skin thickness. These effects are minimized in this concept by using a pyramidal surface in which the field enters the material normal to at least one surface at almost all incident angles. The attenuation is over 20 dB, from S through Ku bands, over a broad angle range of up to 75 degrees off normal. An added benefit is that this system has a rigidity that is suitable for many structural applications.

25 Claims, 1 Drawing Sheet

FIG. 1
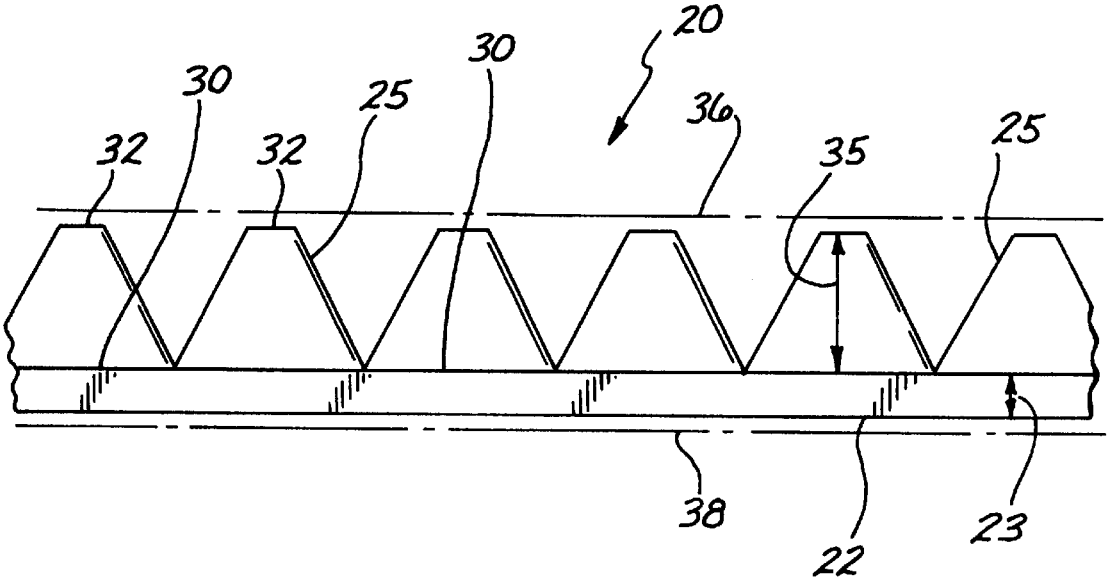
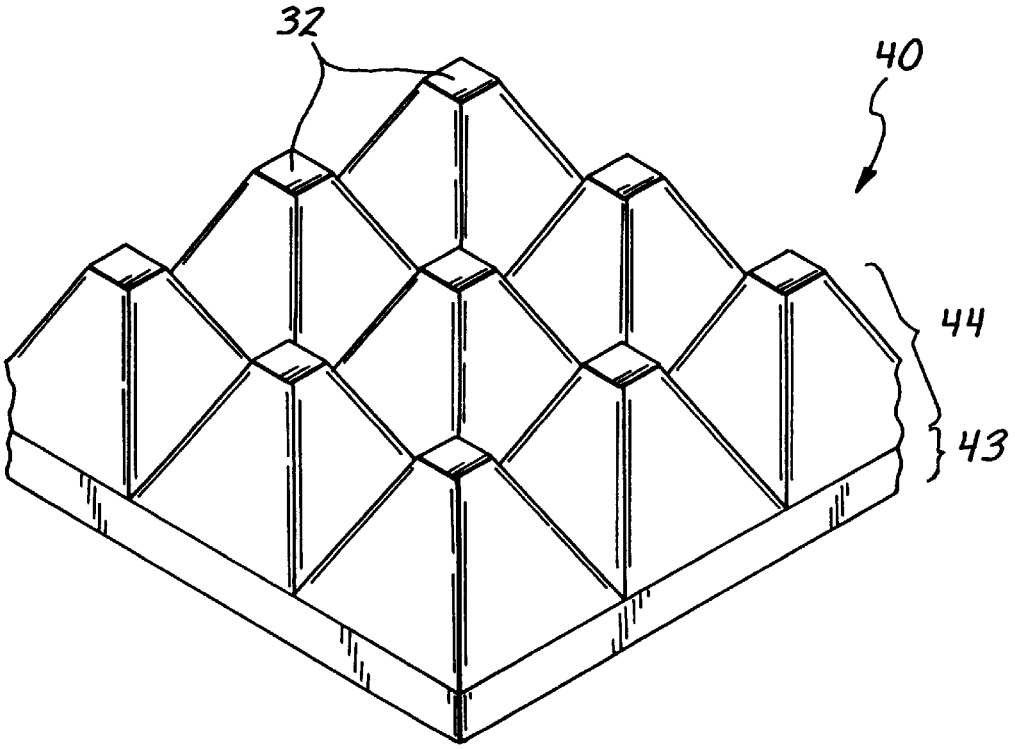
FIG. 2

THERMOPLASTIC SYNTACTIC FOAM WAFFLE ABSORBER

BACKGROUND OF THE INVENTION

1. Field of the Invention

The present invention relates generally to structural materials and, more particularly, to structural materials having radar absorption characteristics.

2. Description of Related Art

A number of electromagnetic energy absorbers exist in the prior art, but none of these electromagnetic energy absorbers have broadband frequency and wide angle response and, further, can be used as structural materials.

Low density non-metallic materials with good mechanical properties are required for a number of aerospace and other structural applications. Radomes that house radar antennas, for example, must have sufficient structural strength to withstand aerodynamic forces. The material used to construct the radome cannot interfere with the signals transmitted therethrough. Structural non-metallic materials, such as epoxies and graphite-epoxy composite materials, have been developed in the prior art. Foamed polymeric materials have also found many uses. The existing polymeric materials and foam polymeric materials have some drawbacks. The foamed polymeric materials are somewhat less controlled than is desired, in that these materials do not have sufficiently high mechanical properties for some applications such as radomes.

Many advantages are associated with lightweight materials which are strong enough to be used as structural components, especially on aircraft. In the area of low-observable materials for use on aircraft, thin and lightweight structural base material concepts have not existed in the prior art. Low-observable materials, suitable for absorbing broadband electromagnetic radiation, usually comprise soft foams having thicknesses on the order of feet instead of inches. These large scale dimensions for the foam absorbers were required in order to provide sufficient frequency response, since smaller dimensions would provide very narrow frequency response for limited angular coverage.

In addition to frequency response, broad angle response is also advantageous for microwave energy absorbers. Foam devices incorporating pyramid structures thereon, for providing broad angle response, are prevalent in the prior art. U.S. Pat. No. 4,942,402 issued to Prewer et al and U.S. Pat. No. 4,496,950 issued to Hemming et al disclose absorbers having pyramidal surfaces. These absorbers have relatively large scale dimensions on the order of feet, are formed of soft foam, and are not suitable for use as structure components. What is needed is a low-observable material with small scale dimensions on the order of inches, formed of a rigid and durable material, and having both broad frequency and wide angle response.

SUMMARY OF THE INVENTION

The electromagnetic energy absorber of the present invention incorporates a fiber loaded thermoplastic syntactic foam having a waffle surface. The fiber loaded thermoplastic syntactic foam of the present invention provides broadband frequency response covering the range of S to Ku bands. Further, the waffle-shaped surface provides a wide angle response of 20 dB attenuation or more for at least 60 degrees, and 10 db out to 75 degrees. The fiber loaded thermoplastic syntactic foam has both stiffness and a high modulus of elasticity that is much greater than conventional foam absorbers, and can be used in very thin sheets as a structural material.

The microwave energy absorber of the present invention includes a base of fiber loaded thermoplastic syntactic foam and a plurality of pyramids formed on the surface of fiber loaded thermoplastic syntactic foam. This electromagnetic energy absorber has both a broadband frequency response, covering S to Ku bands, and a wide angle response of at least 75 degrees. Each of the plurality of pyramids of the microwave energy absorber may be truncated for structural applications.

According to one aspect of the present invention, the base forms a base plane, and each of the plurality of truncated pyramids has a bottom end near the base and a top end opposite the bottom end. A first area of a first plane, which is parallel to the base plane and which lies within the bottom end of one of the truncated pyramids, is greater than a second area of a second plane, which is parallel to the base plane and which lies within a top end of one of the truncated pyramids. A height of each of the truncated pyramids is defined as a shortest distance between the bottom end and the top end of the truncated pyramid. Each of the truncated pyramids includes four sides disposed between the bottom end and the top end of the truncated pyramid. The first area may be approximately one square inch, and the second area may be approximately one-quarter of a square inch.

According to another aspect of the present invention, the base has a first side and a second side, and the plurality of truncated pyramids are disposed on the second side. The electromagnetic energy absorber has a total thickness which consists of both a height of the base, measured between the first side and the second side of the base, and a height of a truncated pyramid, measured between the first plane and the second plane of the truncated pyramid. A ratio of the height at the base to the width of the truncated pyramids is less than or equal to two.

The ratio of the height at the base to the width of the truncated pyramids can be in a range of from one-third to two, and the ratio of the first area to the second area if truncated, can be approximately sixteen or greater. The height of the base can be approximately one eighth to one half of an inch, and the height of one of the truncated pyramids can be approximately one fourth to one and a half inches. Additionally, the ratio of the height of the truncated pyramids to the total thickness of the electromagnetic energy absorber is greater than or equal to one fourth.

In one configuration, the loaded thermoplastic syntactic foam absorber may have a base height of approximately one quarter of an inch, and may have pyramid heights of approximately ¾ of an inch. An area of the bottom end of each pyramid is approximately one square inch, and an area of the top end of each pyramid is approximately one-sixteenth of a square inch.

According to another feature of the present invention, a thin magnetic radar absorbing material may be disposed over the base in a layer approximately 0.060 inch thick.

According to yet another feature of the present invention, a layer of low dielectric material is disposed over the entire structure. The layer of low dielectric material adds extra strength to the base and reduces diffuse scattering.

The present invention utilizes the combined effect of geometry and an existing artificial dielectric absorbing structural material. This geometric effect reduces the grazing angle reflection of a single or multiple layers by adding the geometry enhancements of pyramidal sides, therefore forcing the incident field to enter more perpendicularly, relative to the surface of the material.

By geometrically reshaping the surface of a fiber loaded thermoplastic syntactic material into a waffle shape, the microwave absorption performance is dramatically improved. Starting with a fiber loaded version of thermoplastic syntactic foam, the front face geometry is then modified. Typically, the angle and frequency response is a function of both the front face angle and the skin thickness. These effects are minimized in this concept by using a pyramidal surface in which the field enters the material normal to at least one surface at almost all incident angles. The attenuation is over 20 dB, from S through Ku bands, over a broad angle range of up to 75 degrees off normal. An added benefit is that this system has a rigidity that is suitable for many structural applications.

The present invention, together with additional features and advantages thereof, may best be understood by reference to the following description taken in connection with the accompanying illustrative drawings.

BRIEF DESCRIPTION OF THE DRAWINGS

FIG. 1 is a cross-sectional view of the fiber loaded thermoplastic syntactic foam waffle absorber of the presently preferred embodiment showing features for various implementations; and FIG. 2 is an orthogonal perspective view of the thermoplastic syntactic foam waffle absorber according to the presently preferred embodiment.

DETAILED DESCRIPTION OF THE PRESENTLY PREFERRED EMBODIMENTS

Turning to FIG. 2, an orthogonal view of the thermoplastic syntactic foam waffle absorber of the presently preferred embodiment is illustrated generally at 40. The thermoplastic syntactic foam waffle absorber comprises a base 22 and pyramids 43 of fiber loaded thermoplastic syntactic foam. The thermoplastic syntactic foam of the present invention has unique electromagnetic energy absorption and structural characteristics. The actual material comprising this foam is disclosed in a copending application entitled Thermoplastic Syntactic Foams and Their Preparation, which was filed by the Assignee of the present invention on Nov. 1, 1993, and which issued into U.S. Pat. No. 5,532,295. This fiber loaded thermoplastic syntactic foam operates on the electric field component of incident electromagnetic radiation, instead of operating on the magnetic field. Although magnetic absorbers operate on the magnetic field of incident electromagnetic radiation, often utilizing Lorence resonances in these magnetic fields, the present invention operates on the electric field of incident radiation and, more particularly, operates on the Debye resonances and the attending energy loss mechanism. Certain artificial dielectric fibers within the thermoplastic syntactic foam absorb the electromagnetic field energy, like small antennae. These resistive fibers absorb portions of the radiation and re-radiate the absorbed energy to other neighboring fibers, resulting in an energy loss. Additionally, the fibers of the thermoplastic syntactic foam of the present invention comprise lossy or resistant material, for converting this energy into heat through the resistance of the electrical currents in the fibers. The electric field is thus decreased by both the retransmission and the generation of heat, in order to provide an efficient absorber. Additionally, this thermoplastic syntactic foam provides very good structural characteristics, such as rigidity and low-weight, and can be used directly on aircraft, for example, to fabricate structural components.

As illustrated in FIG. 1, the base 22 of the fiber loaded thermoplastic syntactic foam waffle absorber can be manufactured having a relatively small height 23, measured perpendicularly to a plane of the base of the thermoplastic syntactic foam waffle absorber. This small height 23, plus the pyramid height 35, is generally sufficient to provide a broadband frequency response to the thermoplastic syntactic foam waffle absorber, which in the preferred embodiment covers the S to Ku bands. In one presently preferred embodiment, the height 23 of the base 22 is approximately one quarter of an inch and the height of the fiber loaded thermoplastic syntactic foam pyramids is three quarters of an inch. In contrast, prior art absorbers were often manufactured in the order of feet, instead of inches, in order to provide comparable broadband frequency response. The fiber loaded thermoplastic syntactic foam waffle absorber 20 of the present invention further comprises a plurality of truncated fiber loaded thermoplastic syntactic foam pyramids 25. Each truncated pyramid comprises a bottom end 30 and a top end 32. The bottom ends 30 and the top ends 32 are preferably square in shape but may also be other polygonal shapes such as hexagonal. In the presently preferred embodiment, each bottom end comprises one square inch, and each top end comprises one sixteenth of a square inch. Thus, in the cross-sectional view of the thermoplastic syntactic foam waffle absorber 20 shown in FIG. 1, a width of each bottom end 30 is approximately one inch, and a width of each top end 32 is approximately one quarter inch. The height 35 of each pyramid, measured in the same direction as the height 35 of the base, is approximately three quarters of an inch.

The truncated pyramids 25 provide a wide angle response, which covers incident angles up to approximately seventy-five to eighty degrees from normal, in the presently preferred embodiment. The base 23 of the fiber loaded thermoplastic syntactic foam does not have very good angle response without the truncated pyramids 25. The truncated pyramids 25 provide for the absorption and scattering of electromagnetic energy radiation at a variety of angles other than angles corresponding to incident radiation substantially perpendicular to the plane of the base 23.

In the embodiment of FIG. 1, a layer of low dielectric material 36 shown in phantom may be disposed over the pyramids 25 and into the region between the pyramids to add increased strength and reduced diffuse scattering to the thermoplastic syntactic foam waffle absorber 20.

The thermoplastic syntactic foam waffle absorber of the embodiment of FIG. 1 may further comprise a thin layer, preferably 0.030"–0.060", of magnetic radar absorbing material 38 shown in phantom disposed below the base 23. This added layer allows the thermoplastic syntactic foam waffle absorber to be made especially thin, due to the plastical magnetic layer disposed thereon.

Another embodiment of the present invention is shown in FIG. 2 where the thermoplastic syntactic foam waffle absorber 40 does not comprise a magnetic layer. The thermoplastic syntactic foam waffle absorber 40 of this embodiment is approximately twice as large in dimensions as the embodiment 20 shown in FIG. 1. The embodiment shown in FIG. 2, however, does not require the magnetic layer, and achieves approximately the same broadband frequency response and wide angle response as the embodiment 20 shown in FIG. 1. Although all of the dimensions of the thermoplastic syntactic foam waffle absorber 40 shown in FIG. 2 are doubled, relative to the embodiment shown in FIG. 1, the important feature of this second embodiment is to have a greater thickness of the base 43 to compensate for the lack of a magnetic layer. In the presently preferred embodiment the magnetic layer comprises magram, which is a magnetic radar absorbing material known in the art.

Although exemplary embodiments of the invention have been shown and described, many other changes, modifications and substitutions, in addition to those set forth in the above paragraphs, may be made by one having ordinary skill in the art without necessarily departing from the spirit and scope of this invention.

We claim:

1. A microwave energy absorber, comprising:

a base of thermoplastic syntactic foam; and a plurality of pyramids formed on the base of thermoplastic syntactic foam, the electromagnetic energy absorber having a broadband frequency response covering S to Ku bands and a wide angle response of at least 75 degrees.

2. The electromagnetic energy absorber according to claim 1, wherein the plurality of pyramids comprises a plurality of truncated pyramids.

3. The microwave energy absorber according to claim 2, wherein the base forms a base plane, and wherein each of the plurality of truncated pyramids has a bottom end near the base and a top end opposite the bottom end, a first area of a first plane, which is parallel to the base plane and which lies within the bottom end of one of the truncated pyramids, being greater than a second area of a second plane, which is parallel to the base plane and which lies within a top end of one of the truncated pyramids.

4. The microwave energy absorber according to claim 3, wherein a height of each truncated pyramid is defined as a shortest distance between the bottom end and the top end of the truncated pyramid.

5. The microwave energy absorber according to claim 4, wherein each of the truncated pyramids comprises four sides disposed between the bottom end and the top end of the truncated pyramid.

6. The microwave energy absorber according to claim 5, wherein the first area is approximately four square inches, and wherein the second area is approximately one-quarter of a square inch.

7. The microwave energy absorber according to claim 3, the base having a first side and a second side, wherein the plurality of truncated pyramids are disposed on the first side, the electromagnetic energy absorber having a total thickness which comprises both a height of the base, measured between the first side and the second side of the base, and a height of a truncated pyramid, measured between the first plane and the second plane of the truncated pyramid, a ratio of the height of the base to the height of the truncated pyramid being less than or equal to one.

8. The microwave energy absorber according to claim 7, wherein the ratio of the height of the base to the height of the truncated pyramids is in a range of from one-third to one, and wherein a ratio of the first area to the second area is approximately sixteen.

9. The microwave energy absorber according to claim 8, wherein the height of base is approximately one half of an inch, wherein the height of one of the truncated pyramids is approximately one and a half inches, wherein the first area is approximately four square inches, and wherein the second area is approximately one-quarter of a square inch.

10. The microwave energy absorber according to claim 3, the first area being approximately sixteen times as large as the second area, for a one inch to one quarter inch system.

11. An electromagnetic energy absorber having both a wide angle response and a broadband frequency response, the electromagnetic energy absorber having a base and a plurality of truncated pyramids formed on a surface thereof, the electromagnetic energy absorber having a total thickness which comprises a height of the base portion and a height of the truncated pyramids, a ratio of the height of the truncated pyramids to the total thickness of the electromagnetic energy absorber being greater than or equal to one half.

12. The electromagnetic energy absorber according to claim 11, wherein the wide angle response is at least seventy-five degrees, and wherein the broadband frequency response is from S to Ku bands.

13. The electromagnetic energy absorber according to claim 11, wherein the ratio of the height of the truncated pyramids to the total thickness of the electromagnetic energy absorber is in a range of from one half to three quarters.

14. An electromagnetic energy absorber having both a wide angle response and a broadband frequency response, the electromagnetic energy absorber having a base and a plurality of pyramids formed on a surface thereof, the electromagnetic energy absorber having a total thickness which comprises a height of the base and a height of the pyramids, a ratio of the height of the base to the height of the pyramids being less than or equal to one.

15. The electromagnetic energy absorber according to claim 14, wherein the ratio of the height of the base to the height of the pyramids is in a range of from one third to one.

16. The electromagnetic energy absorber according to claim 15, wherein the plurality of pyramids comprises a plurality of truncated pyramids.

17. The electromagnetic energy absorber according to claim 14, wherein the wide angle response is at least seventy-five degrees, and wherein the broadband frequency response is from S to Ku bands.

18. A microwave energy absorber, comprising:

a layer of magnetic radar absorbing material;

a base of thermoplastic syntactic foam disposed on the layer of magnetic radar absorbing material; and a plurality of pyramids formed in the base of the thermoplastic syntactic foam, wherein a broadband frequency response of the microwave energy absorber comprises S to Ku bands and a wide angle response of the microwave energy absorber comprises at least seventy-five degrees.

19. The microwave energy absorber according to claim 18, the microwave energy absorber having a total thickness which comprises a height of the base and a height of the pyramids, a ratio of the height of the pyramids to the total thickness of the microwave energy absorber being greater than or equal to one half.

20. The microwave energy absorber according to claim 18, wherein the plurality of pyramids comprises a plurality of truncated pyramids, each truncated pyramid comprising a bottom end contacting the base and a top end opposite the bottom end.

21. The microwave energy absorber according to claim 20, wherein the height of the base is approximately one quarter of an inch, wherein the height of one of the truncated pyramids is approximately three quarters of an inch, wherein an area of the bottom end is approximately one square inch, wherein an area of the top end is approximately one-sixteenth of a square inch, and wherein the layer of magnetic radar absorbing material is approximately 0.06 inch thick.

22. A material operable as both a structural component and a microwave energy absorber, comprising:

a base of fiber-loaded thermoplastic syntactic foam;

a plurality of pyramids formed in the base of the fiber-loaded thermoplastic syntactic foam;

a layer of low dielectric material disposed over the plurality of pyramids, the layer of low dielectric material adding strength to the material, and forming a smooth surface which is adapted for receiving an optional composite skin thereon.

23. The material as recited in claim 22, further comprising a layer of magnetic radar absorbing material.

24. The material as recited in claim 22, further comprising a layer of magnetic radar absorbing material.

25. A non-magnetic microwave energy absorber, comprising:

a base of fiber-loaded thermoplastic syntactic foam, the fiber-loaded thermoplastic syntactic foam having only electrical absorption characteristics and not having any magnetic absorption characteristics; and a plurality of pyramids geometrically formed in the base of the fiber-loaded thermoplastic foam, wherein a broadband frequency response of the non-magnetic microwave energy absorber comprises S to Ku bands and a wide angle response of the microwave energy absorber comprises at least seventy-five degrees.

* * * * *